US011333420B2

(12) United States Patent
Makoto et al.

(10) Patent No.: US 11,333,420 B2
(45) Date of Patent: May 17, 2022

(54) REFRIGERATOR PREVENTING CONDENSATION IN A DIVIDED PORTION OF A HOUSING BODY THEREOF

(71) Applicant: Samsung Electronics Co., Ltd., Suwon-si (KR)

(72) Inventors: Shibuya Makoto, Yokohama (JP); Iwamoto Tomoharu, Yokohama (JP); Matsuno Tomohiko, Yokohama (JP); Seo Tatsuya, Yokohama (JP); Aoki Ryota, Yokohama (JP); Takase Hitoshi, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 327 days.

(21) Appl. No.: 16/557,674

(22) Filed: Aug. 30, 2019

(65) Prior Publication Data

US 2020/0072525 A1 Mar. 5, 2020

(30) Foreign Application Priority Data

Aug. 31, 2018 (JP) ..... JP2018-162565
Sep. 12, 2018 (JP) ..... JP2018-170692
(Continued)

(51) Int. Cl.
*F25D 11/02* (2006.01)
*F25D 23/00* (2006.01)
*F25D 23/06* (2006.01)

(52) U.S. Cl.
CPC ..... *F25D 11/02* (2013.01); *F25D 23/006* (2013.01); *F25D 23/063* (2013.01);
(Continued)

(58) Field of Classification Search
CPC ..... F25D 11/02; F25D 19/00; F25D 17/065; F25D 23/006; F25D 23/063;
(Continued)

(56) References Cited

U.S. PATENT DOCUMENTS 2,610,100 A 9/1952 Childers
2018/0202701 A1 7/2018 Kim et al.

FOREIGN PATENT DOCUMENTS

CN 201368639 Y 12/2009
CN 102705968 A 10/2012
(Continued)

OTHER PUBLICATIONS

Supplementary European Search Report dated Jul. 16, 2021 in connection with European Application No. 19853499.2, 7 pages.
(Continued)

*Primary Examiner* — Steve S Tanenbaum

(57) ABSTRACT

A refrigerator includes a housing body including an inner space of the refrigerator and a cooling cycle mechanism configured to cool the inner space. The housing body includes a plurality of housing body elements separated along a predetermined separate surface, and the plurality of housing body elements is removably coupled to each other to allow an end surface of one of the plurality of housing body elements to face an end surface of another one of the plurality of housing body elements. A sealing mechanism
(Continued)

configured to form an air surface between opposite end surfaces is provided to prevent air from flowing into or from the inner space through between the opposite end surfaces.

11 Claims, 17 Drawing Sheets

(30) Foreign Application Priority Data

Nov. 7, 2018 (JP) ..... JP2018-210044
Aug. 7, 2019 (KR) ..... 10-2019-0096090

(52) U.S. Cl.
CPC ..... *F25D 23/065* (2013.01); *F25D 23/069* (2013.01); *F25D 2321/00* (2013.01); *F25D 2600/04* (2013.01)

(58) Field of Classification Search
CPC .. F25D 23/065; F25D 23/069; F25D 2321/00; F25D 2600/04; F25D 23/087; F25B 13/00; F25B 1/00
USPC ..... 62/298, 440
See application file for complete search history.

(56) References Cited

FOREIGN PATENT DOCUMENTS

| | | | | |
|---|---|---|---|---|
| CN | 106679307 | A | | 5/2017 |
| DE | 254425 | A1 | | 2/1988 |
| JP | S57-85178 | U | | 5/1982 |
| JP | H04-001387 | U | | 1/1992 |
| JP | H06-109356 | A | | 4/1994 |
| JP | 2015-155591 | A | | 8/2015 |
| KR | 10-1993-0008415 | A | | 5/1993 |
| KR | 20-0117021 | Y1 | | 6/1998 |
| KR | 20-1999-0027052 | U | | 7/1999 |
| KR | 20030027367 | A | * | 4/2003 |
| KR | 10-2016-0012645 | A | | 2/2016 |

OTHER PUBLICATIONS

International Search Report for International Application No. PCT/KR2019/011081 dated Dec. 26, 2019, 3 pages.
China National Intellectual Property Administration, "The First Office Action", dated Nov. 12, 2021, in connection with Chinese Patent Application No. 201980056170.2, 17 pages.

* cited by examiner

REFRIGERATOR PREVENTING CONDENSATION IN A DIVIDED PORTION OF A HOUSING BODY THEREOF

CROSS-REFERENCE TO RELATED APPLICATIONS

This application is based on and claims priority under 35 U.S.C. 119 to Korean Patent Application No. 10-2019-0096090, filed on Aug. 7, 2019, in the Korean Intellectual Property Office, which claims the benefit of Japanese Patent Application No. 2018-162565 filed on Aug. 31, 2018, No. 2018-170692 filed on Sep. 12, 2018 and No. 2018-210044 filed on Nov. 7, 2018 in the Japan Patent Office, the disclosures of which are herein incorporated by reference in their entireties

BACKGROUND

1. Field

The disclosure relates to a refrigerator.

2. Description of Related Art

Some conventional refrigerators are provided with a housing forming an inner space of the refrigerator, and a cooling cycle mechanism including a variety of devices for cooling the inner space of the refrigerator, and the conventional refrigerator has a structure in which the cooling cycle mechanism is collectively arranged in a predetermined position of the housing.

As for the conventional refrigerator described above, each device forming the cooling cycle mechanism may be accessed at one time, and thus it is possible to easily perform the maintenance.

Meanwhile, it is required that an evaporator among the devices forming the cooling cycle mechanism is placed in the inner space of the refrigerator. Therefore, it is required to separate and remove a part of the housing forming the inner space to easily access to the evaporator like as other devices forming the cooling cycle mechanism.

However, when the housing is divided, heat conduction between the inside and outside of the refrigerator may easily occur in a divided portion. Further, the evaporator is configured to re-cool gas that cools the inner space of the refrigerator and thus the temperature is lowered particularly in the vicinity of the evaporator in the inner space of the refrigerator. As a result, when the housing is divided in the vicinity of the evaporator as in the refrigerator disclosed in patent document 1, a large temperature difference is generated between the inside and outside of the refrigerator in the divided portion, and condensation easily occurs on the outer surface of the housing toward the outside of the refrigerator.

SUMMARY

Therefore, it is an aspect of the disclosure to provide a refrigerator capable of allowing easy access to an evaporator forming a cooling cycle mechanism, and capable of preventing condensation in a divided portion of a housing body.

Additional aspects of the disclosure will be set forth in part in the description which follows and, in part, will be obvious from the description, or may be learned by practice of the disclosure.

In accordance with an aspect of the disclosure, a refrigerator includes a housing body including an inner space of the refrigerator, and a cooling cycle mechanism configured to cool the inner space of the refrigerator, and the housing body includes a plurality of housing body elements separated along a predetermined separate surface, and the plurality of housing body elements is removably coupled to each other to allow an end surface thereof to face each other, and a sealing mechanism configured to form an air surface between opposite end surfaces is provided to prevent air from flowing into or from the inner space through between the opposite end surfaces.

Accordingly, by separating the other housing body element from the housing body element forming a main portion of the inner space of the refrigerator, an evaporator arranged in the inner space of the refrigerator may be easily accessed and thus the maintainability may be improved.

In the inner space of the refrigerator, an end surface of the plurality of housing body elements is connected to each other in the vicinity of the evaporator where low temperature gas gathers, and an air surface is formed between opposite end surfaces by a sealing mechanism. The air surface serves as an insulating layer and thus the heat conduction between the inside and the outside of the refrigerator between the opposite end faces is alleviated. Particularly, heat is hardly transmitted from the inside to the outside of the refrigerator between the opposite end faces, and thus condensation may be prevented from occurring near the opposite end surfaces on the outer surface of the housing.

In addition, in the vicinity of the evaporator in the inner space of the refrigerator, a temperature in the vicinity of an exit surface, from which the gas re-cooled from the evaporator is discharged, is further lowered. Therefore, the evaporator may introduce a gas, which cools the inner space of the refrigerator, from an entrance surface and re-cool the gas and then discharge the re-cooled gas to the exit surface. The exit surface may be arranged in a position according to the end surface of one of the housing body elements, and the sealing mechanism may form the air surface along the exit surface.

Accordingly, because by the sealing mechanism, the air surface is formed between the opposite end surfaces positioned on the exit surface side of the evaporator, in which air having a temperature lower than that of the inner space of the refrigerator is collected, the heat conduction between the inside and the outside of the refrigerator between the opposite end surfaces is alleviated. Further, because it is possible to allow the position of the opposite end surfaces to be close to the evaporator, it is possible to make the housing body element provided with the evaporator smaller.

The both housing body elements each may include an insulating material and an exterior material covering the insulating material, and the exterior material may have a thermal conductivity higher than that of the insulating material.

Based on the both housing body elements having such a structure, the exterior material are superposed on the opposite end surfaces facing each other. Therefore, the heat of the inside and outside of the refrigerator may be easily transferred through the exterior material, but it is possible to suppress the heat transfer by forming the air surface by using the sealing mechanism.

At least one portion of the opposite end surfaces may be formed to be inclined from a rear surface of the housing body toward a bottom surface of the housing body. By such a structure, the heat transferred to the inside and the outside of the refrigerator may be easily blocked by the air surface.

As for the configuration of the sealing mechanism, the sealing mechanism may include a sealing member inserted between the opposite end surfaces so as to form a gap between the opposite end surfaces, and a partition member configured to partition the gap formed between the opposite end surfaces so as to form the air surface with the sealing member. Further, the sealing mechanism may further include a blocking member installed on an outer surface of the plurality of housing body elements to block the gap between the opposite end surfaces.

The partition member may form at least one air surface by partitioning the gap, which is formed between the opposite end surfaces, into the form of frame. With such a structure, the air surface may be formed at an appropriate position in the circumferential direction of opposite end surfaces.

The partition member may be formed in such a way that the exterior material forming at least one of the opposite end surfaces protrudes toward the other end surface As for the housing body, one housing body element may form a main portion of the inner space of the refrigerator, and the other housing body element may be coupled to the one housing body element to form a part of the inner space of the refrigerator, together with the one housing body element.

The other housing body element may form a machine room in the outside of the refrigerator, and the cooling cycle mechanism may be arranged in the inside of the refrigerator, in the other housing body element. Because the one housing body element is separated from the other housing body element with such a structure, the cooling cycle mechanism may be separated from the one housing body element and thus the maintainability may be further improved.

The one housing body element may further include a partition configured to divide the inner space into a storage room and a re-cooling room configured to re-cool gas cooling the storage room. The second housing body element may be removably coupled to the one housing body element so as to form the re-cooling room, together with the first housing body element and the partition. The evaporator may be placed in the re-cooling room while the evaporator is installed inside of the refrigerator in the other housing body element.

A heat transfer member configured to induce heat toward the outside of the refrigerator with respect the end surface may be installed on one of the plurality of housing body elements In accordance with an aspect of the disclosure, a refrigerator includes a housing body including an inner space of the refrigerator, and a cooling cycle mechanism configured to cool the inner space of the refrigerator, and the housing body includes a plurality of housing body elements separated along a predetermined separate surface, and the plurality of housing body elements is removably coupled to each other to allow an end surface thereof to face each other, and a heat transfer member configured to induce heat toward the outside of the refrigerator with respect the end surface is installed on one of the plurality of housing body elements.

The plurality of housing body elements may include a first housing body element configured to form a main portion of the inner space of the refrigerator, and a second housing body element coupled to the first housing body element to form a part of the inner space of the refrigerator, together with the first housing body element.

The first housing body element and the second housing body element each may include an outer wall and an inner wall, and the heat transfer member may be installed between the outer wall and the inner wall of at least one of the first housing body element and the second housing body element.

The heat transfer member may be installed over on inner surface of the external wall and a rear surface of the end surface of at least one of the first housing body element and the second housing body element.

A part, in which the heat transfer member is installed among the rear surface of the end surface, may be equal to or less than half of a length from the external wall to the inner wall in the rear surface.

A thermal conductivity of the heat transfer member may be greater than a member forming the housing body or a member forming the cooling cycle mechanism.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The disclosure will be described more fully hereinafter with reference to the accompanying drawings.

A refrigerator 100 according to an embodiment is mainly used in general households. However, the disclosure is applicable not only to a domestic refrigerator but also to a commercial refrigerator. In addition, the refrigerator according to an embodiment includes not only a refrigerator provided with a refrigerating compartment and a freezing compartment but also a refrigerator provided with only refrigerating compartment or a refrigerator provided with only freezing compartment.

Figure 1:
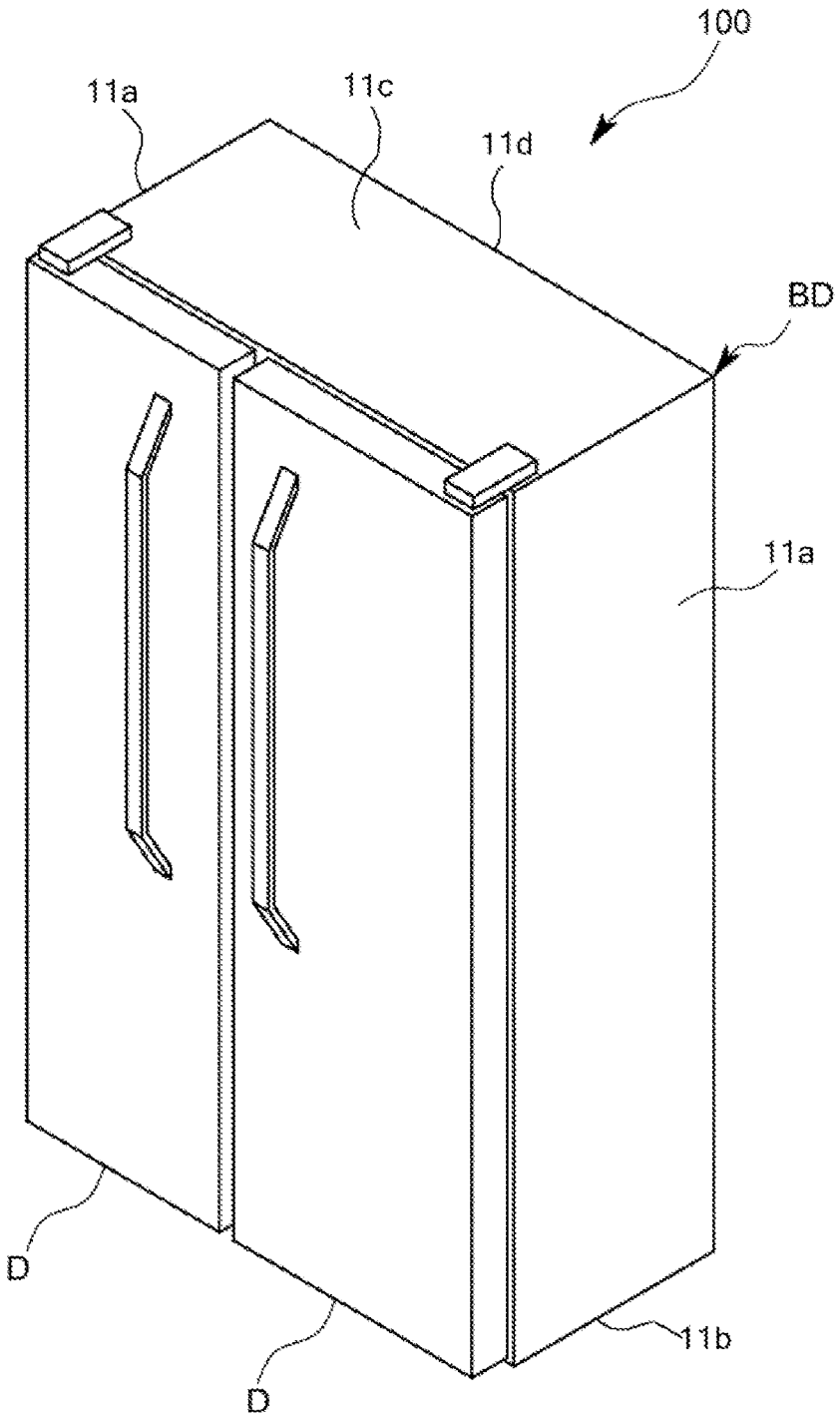
FIG. 1 is a perspective view illustrating a refrigerator according to an embodiment of the disclosure.
Figure 2:
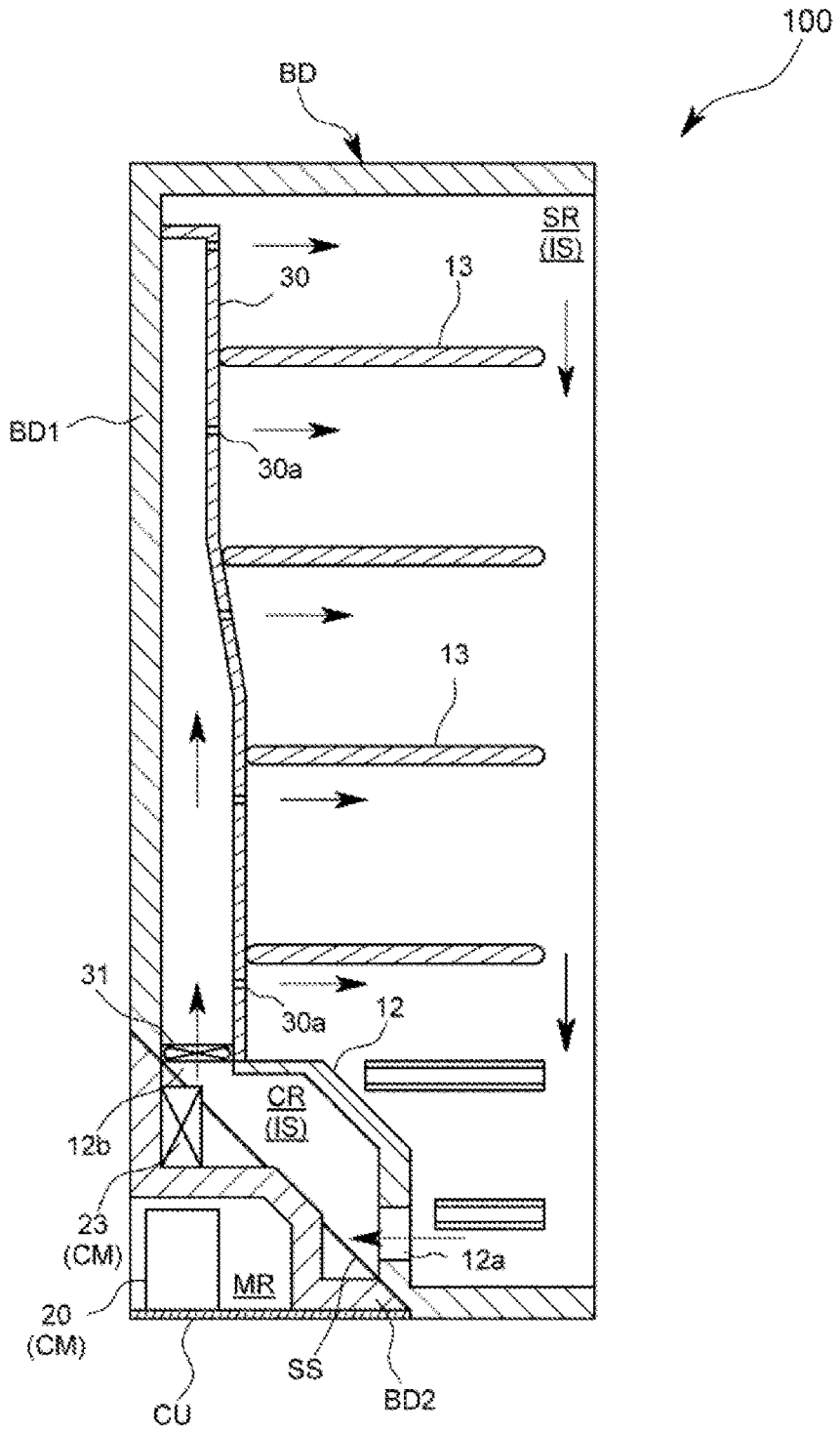
FIG. 2 is a cross-sectional view schematically illustrating a state in which a second housing body element is connected to a first housing body element of the refrigerator according to an embodiment of the disclosure.

As illustrated in FIGS. 1 and 2, the refrigerator 100 according to an embodiment includes a refrigerator housing body (BD) forming an inner space (IS) of the refrigerator and a cooling cycle mechanism (CM) provided with each device configured to cool the inner space IS. Further, the cooling cycle mechanism CM according to an embodiment includes a compressor 20, a blowing fan 21, a condenser 22 and an evaporator 23.

The housing body BD includes opposite side plates 11*a*, a bottom plate 11*b*, a ceiling plate 11*c* and a rear plate 11*d*, and a front (front surface) side thereof is opened. The opposite side plates 11*a*, the bottom plate 11*b*, the ceiling plate 11*c* and the rear plate 11*d* each may be formed by an insulting material 10*a*, and an exterior material 10*b* covering the insulting material 10*a*.

Figure 8:
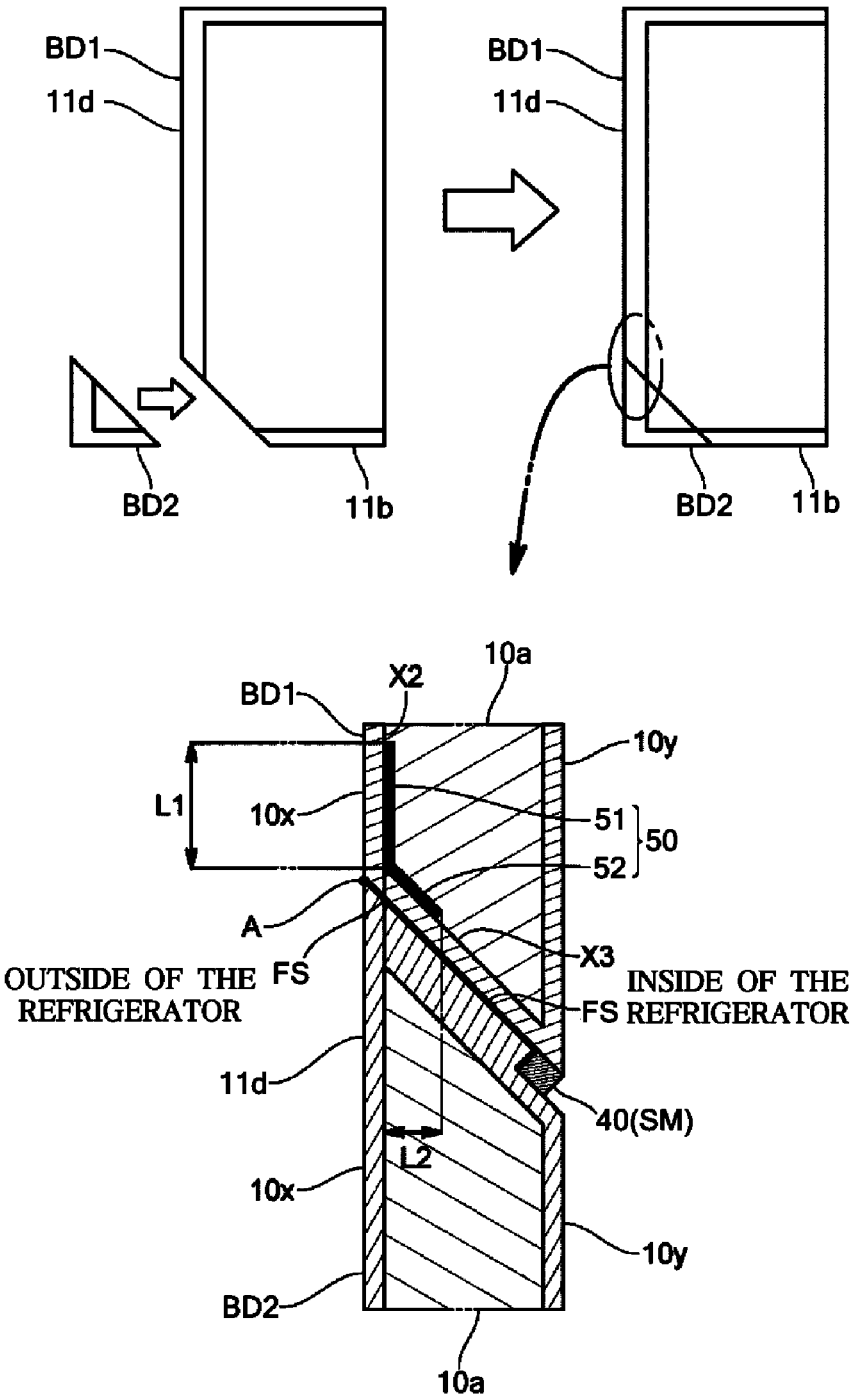
FIG. 8 is a schematic diagram illustrating a heat transfer member according to another embodiment of the disclosure.

The exterior material 10*b* may include an outer wall 10*x* and an inner wall 10*y* (refer to FIG. 8). In the housing body BD, a pair of doors D is installed using a hinge to close an opening.

In addition, the housing body BD is divided into two housing body elements (BD1 and BD2) along a predetermined separate surface (SS), as illustrated in FIG. 2. Particularly, the housing body BD is divided into the two housing body elements BD1 and BD2 along a tilted separate surface SS extending from the back surface (rear surface) to the bottom surface. The two housing elements body elements BD1 and BD2 may be joined by facing end surfaces (facing surface; FS) appearing in the separate surface SS, each other.

Figure 3:
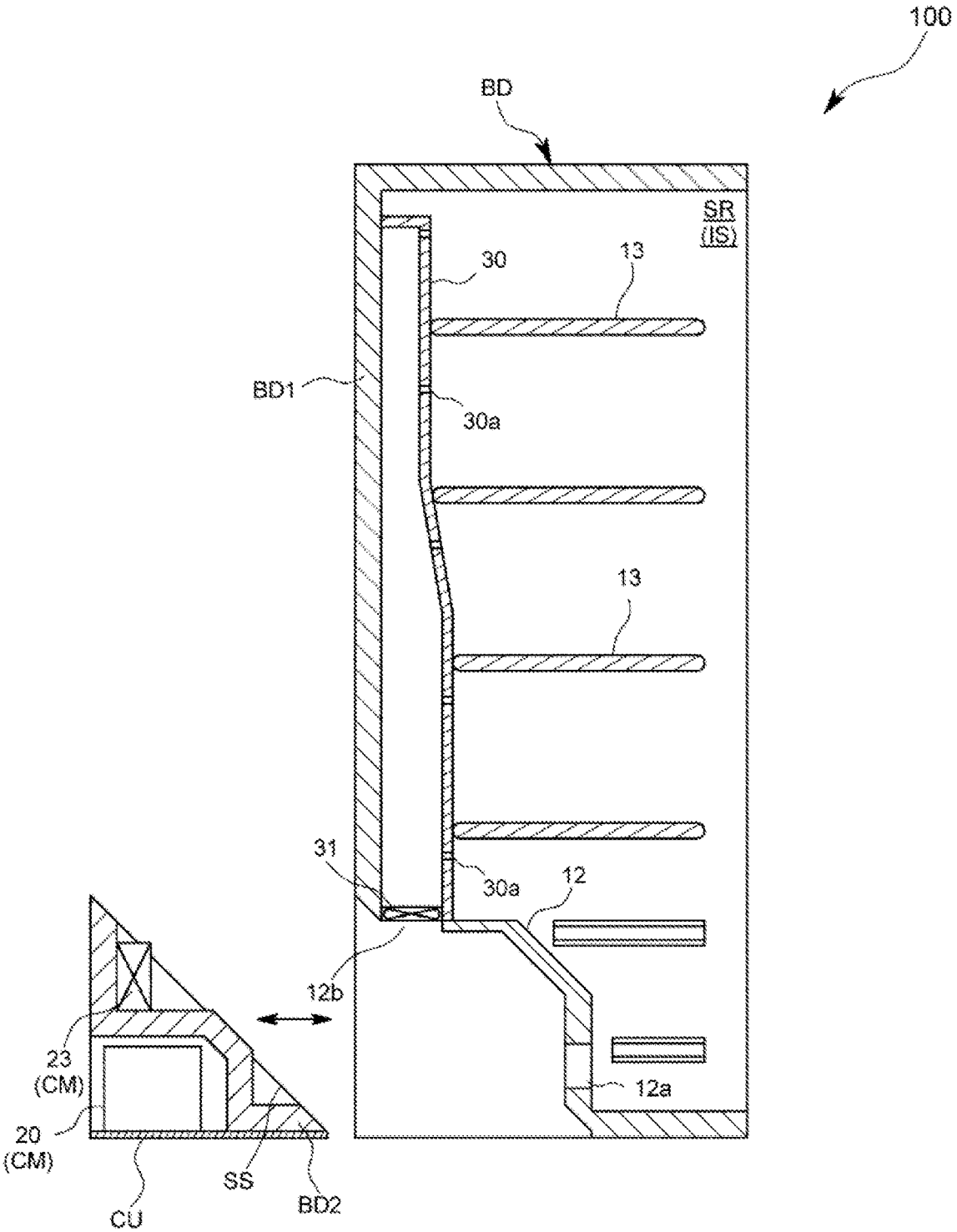
FIG. 3 is a cross-sectional view schematically illustrating a state in which the second housing body element is not connected to the first housing body element of the refrigerator according to an embodiment of the disclosure.

Between the two housing body elements BD1 and BD2, one side housing body element B1 (hereinafter referred to as "first housing body element BD1") occupies a main portion of the inner space IS and arranged in the front side about the separate surface SS, as illustrated in FIGS. 2 and 3.

Further, in the first housing body element BD1, a partition 12 configured to divide the inner space IS into the front side and the separate surface SS side may be installed in the inside forming the inner space IS. In the first housing body element BD1, a storage room (SR) configured to be opened and closed by one pair of doors D may be formed in the front side of the partition 12, and a part of a re-cooling room (CR) configured to re-cool gas cooling the storage room SR may be formed in the separate surface SS side of the partition 12.

In the storage room SR, a plurality of shelves 13 may be provided on the upper side, and a plurality of drawers (not shown) may be provided on the lower side. The partition 12 may be provided with an inlet 12*a* introducing gas from the storage room SR to the re-cooling room CR along the bottom surface, and an outlet 12*b* transferring the gas from the re-cooling room CR to the storage room SR along the back surface.

In the first housing body element BD1, a duct 30 extending from the outlet 12*b* provided in the partition 12 to the storage room SR may be installed. The duct 30 may be provided with a wind inlet 30*a* installed in accordance with a height of each shelf 13 or the drawer of the storage room SR, and a fan 31 may be installed around the outlet 12*b* of the partition 12.

Figure 4:
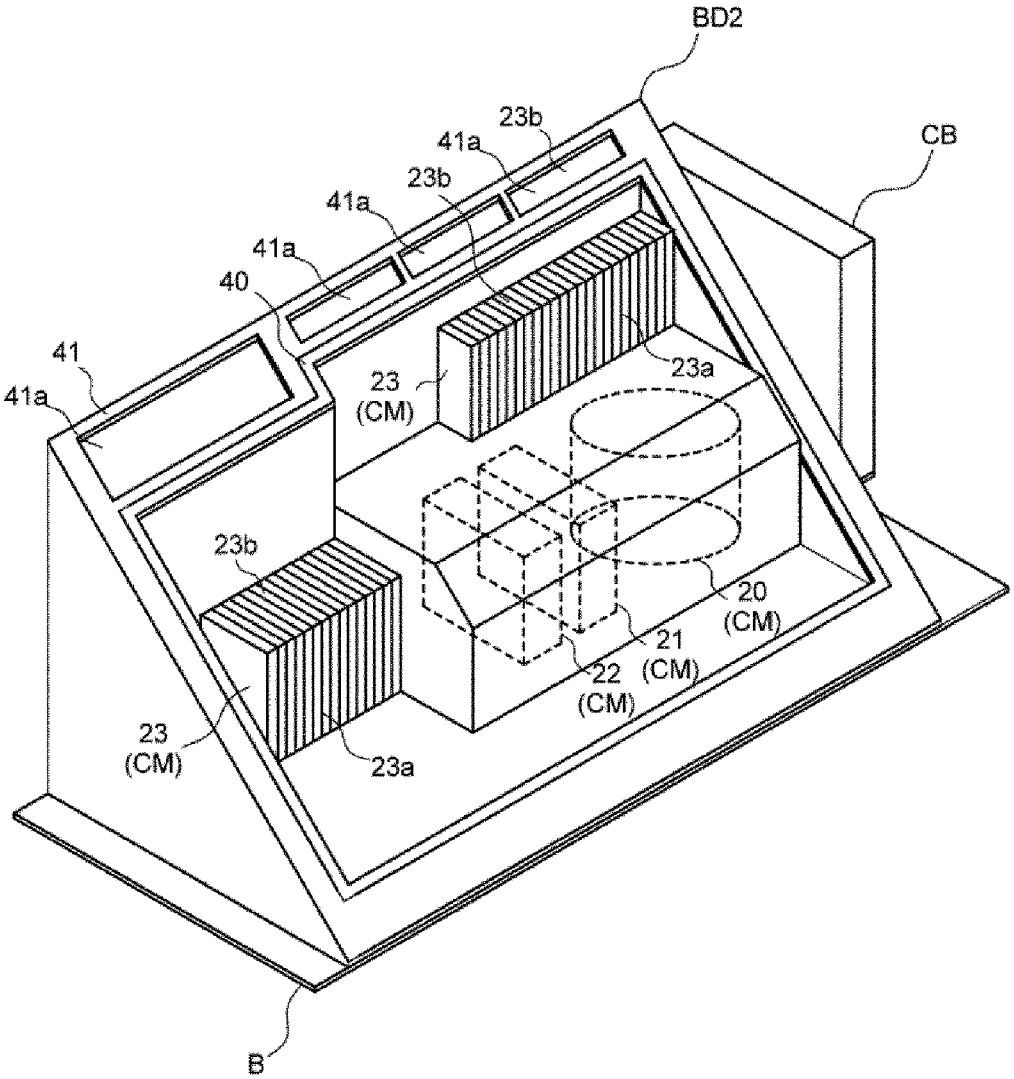
FIG. 4 is a perspective view schematically illustrating a cooling unit including the second housing body element of the refrigerator according to an embodiment of the disclosure.

Between the two housing body elements BD1 and BD2, the other side housing body element B2 (hereinafter referred to as "second housing body element BD2"), is connected to the first housing body element BD1 to form the re-cooling room CR together with the first housing body element BD1, as illustrated in FIGS. 2 to 4. Further, the second housing body element BD2 forms a machine room (MR) at the outside of the refrigerator, and in the machine room MR, the compressor 20, the blowing fan 21 and the condenser 22 may be placed.

The second housing body element BD2 may be provided with two evaporators 23 in the inside of the refrigerator in the second housing body element BD2. The second housing body element BD2 and the cooling cycle mechanism CM are installed on a support board (B) together with a control box (CB) to constitute the cooling unit.

Thus, the second housing body element BD2 may be detachably connected to the first housing body element BD1 as the cooling unit. Further, each devices forming the cooling cycle mechanism CM may be connected through a pipe (not shown), and a part of the pipe may pass through the second housing body element BD2 to be connected to each device in the machine room MR side and to be connected to two or more evaporators 23.

When the first housing body element BD1 and the second housing body element BD2 are coupled to each other, the storage room SR and the re-cooling room CR may be formed in the inner space of the refrigerator, and the machine room MR may be formed in the outer space of the refrigerator. Among the devices constituting the cooling cycle mechanism CM, the evaporator 23 may be placed in the re-cooling room CR in the inner space of the refrigerator, and the compressor 20, the blowing fan 21 and the condenser 22 may be placed in the machine room MR in the outer space of the refrigerator. The evaporator 23 may introduce gas, which flows into the re-cooling chamber CR along the bottom surface from the inlet 12*a* of the partition 12 into the re-cooling chamber CR, from an entrance surface 23*a* and exchange heat with the gas and re-cool the gas. The evaporator 23 may transmit the re-cooled gas to the outlet 12*b* of the partition 12 from an exit surface 23*b* along the rear surface. Hereinafter the connection structure of the first housing element BD1 and the second housing element BD2 will be described in detail.

The first housing body element BD1 and the second housing body element BD2 may be coupled to each other by facing the end surfaces (facing surface: FS) appearing in the separate surface SS, each other. Because the housing body BD is divided by the inclined separate surface SS from the rear surface to the bottom surface, the end surfaces (facing surface: FS) of the first housing element body BD1 and the second housing body element BD2 are inclined. Between opposite end surfaces (facing surfaces: FS), a sealing mechanism (SM) configured to form an air surface (AS) in which air flow is limited between opposite end surfaces (facing surfaces: FS), may be provided to prevent air from flowing between the inside and the outside of the refrigerator.

Figure 5:
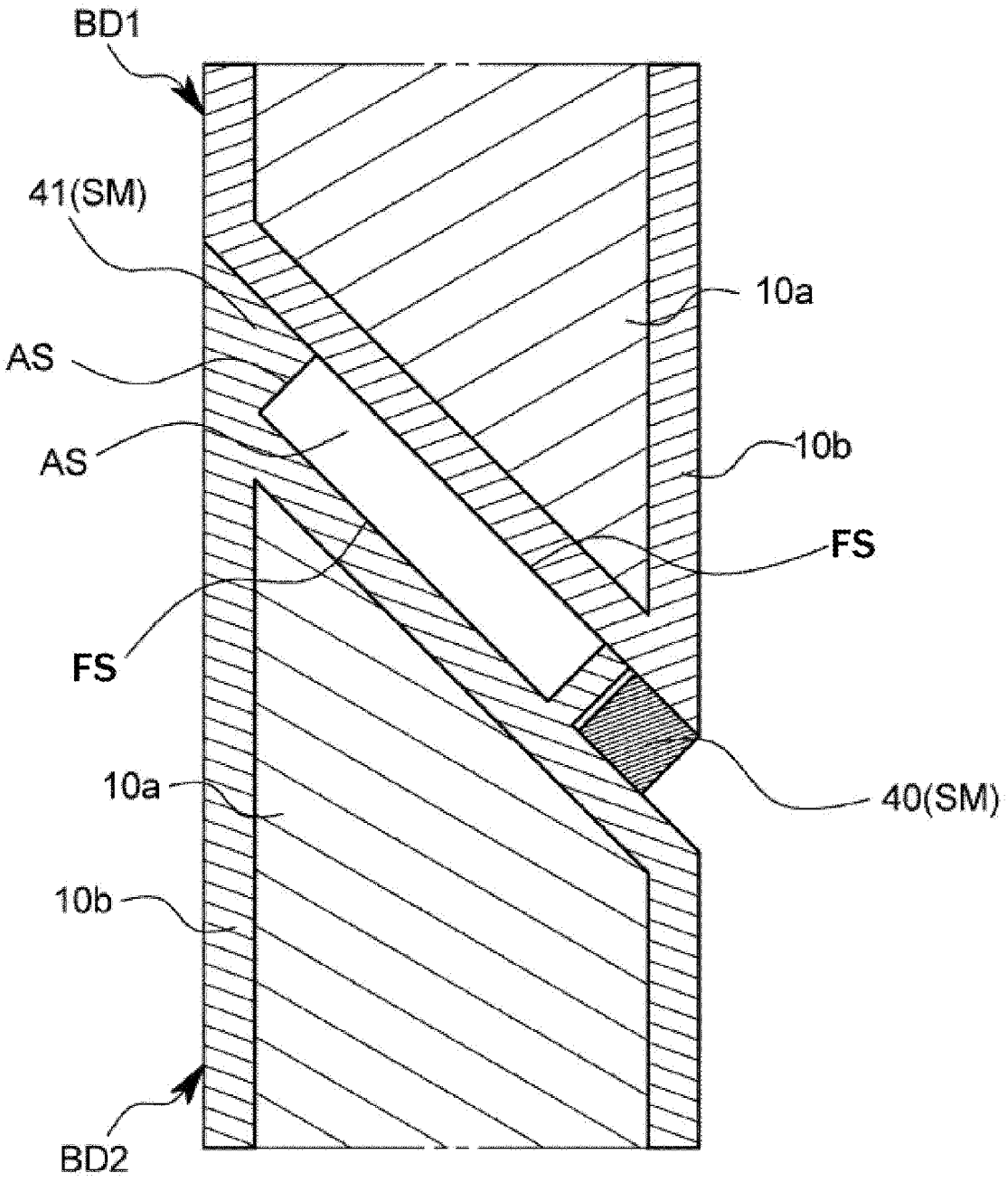
FIG. 5 is a partial cross-sectional view schematically illustrating a connection structure between the first housing body element and the second body element of the refrigerator according to an embodiment of the disclosure.

In addition, as illustrated in FIG. 5, the first housing body element BD1 and the second housing body element BD2 each may have a coated structure in such a way that the insulating material 10*a* is coated with the exterior material 10*b* having a higher thermal conductivity than the insulating material 10*a*. Therefore, the first housing body element BD1 may be coupled to the second housing body element BD2 by facing the exterior material 10*b* forming the end surface (facing surface: FS), each other.

Particularly, the sealing mechanism SM may include a sealing member 40 formed in a circumferential direction along the opposite end surfaces (facing surface: FS), and a partition member 41 forming the air surface AS by partitioning a gap formed between the opposite end surfaces (facing surface: FS) by the sealing member 40.

The sealing member 40 serves to prevent the gas from flowing between the inside and the outside of the refrigerator while forming a gap between the opposite end surfaces (facing surface: FS). Particularly, the sealing member 40 having a fine width shape having elasticity may be attached to any one end surface (facing surface: FS) by an adhesive. Further, according to an embodiment, the sealing member 40 may be installed along in the circumferential direction in the inside of the refrigerator in the end surface (facing surface: FS) of the second housing body element BD2, as illustrated in FIG. 4.

The partition member 41 partitions the gap, which is formed the opposite end surfaces (facing surface: FS) by the sealing member 40, so as to form the air surface AS. According to an embodiment, the partition member 41 is integrally formed with the exterior material 10*b* forming the end surface (facing surface: FS) of the second housing body element BD2.

Particularly, the partition member 41 is formed in such a way that the exterior material 10*b* of the end face (facing surface: FS) of the second housing body element BD2 protrudes toward the end face (facing surface: FS) of the first housing body element BD1. In addition, the partition member 41 is formed along the circumferential direction of the end face (facing surface: FS) along the sealing member 40 and a plurality of recessed portions 41*a* is formed in such a way that the exterior material 10*b* does not protrude toward the end face (facing surface: FS) on a portion thereof. Accordingly, the partition member 41 may be formed in the frame shape surrounding the some recessed portions 41*a*.

When the end surfaces (facing surface: FS) of the first housing body element BD1 is coupled to the end surfaces (facing surface: FS) of the second housing body element BD2 by facing each other, the sealing member 40 may be inserted by the opposite end faces (facing surface: FS) and the partition member 41 may be interposed in the gap formed between the opposite end faces (facing surface: FS) by the sealing member 40. In the gap, the air surface AS partitioned by the partition member 41 is formed.

Another embodiment of the sealing mechanism SM according to an embodiment is in the followings. That is, a sealing mechanism SM as illustrated in FIG. 6A is a modification of the partition member 41 in the sealing mechanism SM according to an embodiment.

Particularly, the partition member 41 having a fine width shape having elasticity is attached to any one end surface (facing surface: FS) by an adhesive, similarly to the sealing member 40. The partition member 41 is arranged along the sealing member 40 to partition between the opposite end faces (facing surface: FS). The sealing member 40 is formed along the inner circumference of the inner side of the refrigerator of the end face (facing surface: FS), the partition member 41 is formed along the outer circumference of the outer side of the refrigerator of the end face (facing surface: FS), and the air surface AS having high air tightness is formed along the circumferential direction of the opposite end surfaces (facing surface: FS) between the sealing member 40 and the partition member 41.

Figure 6A:
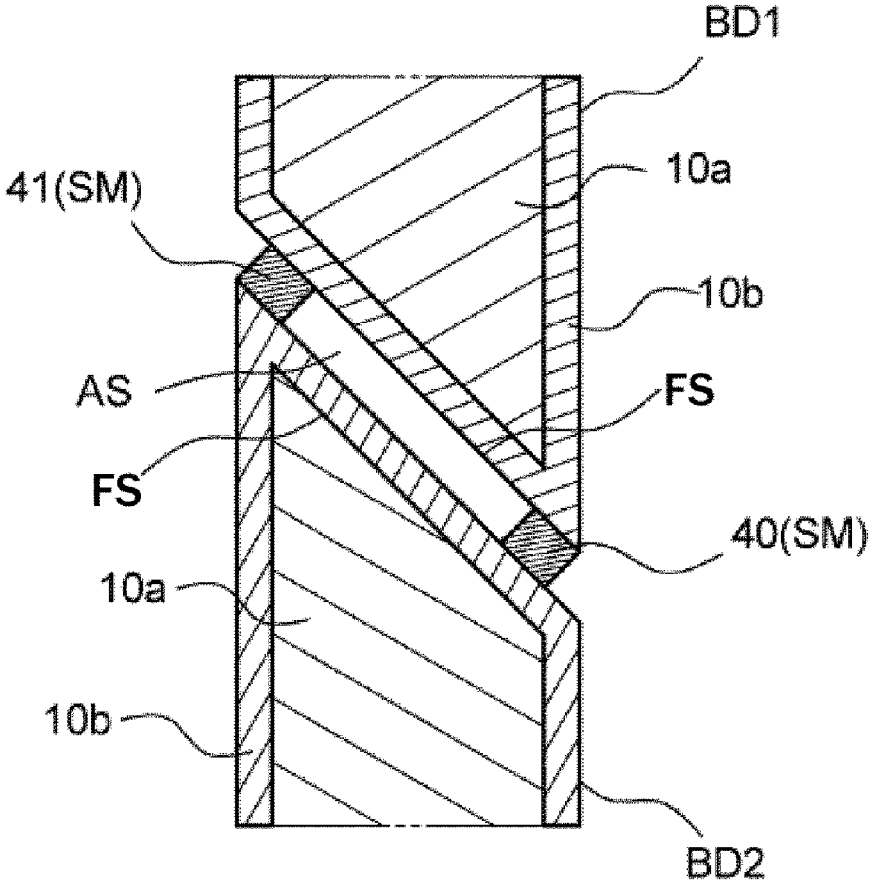
FIGS. 6A to 6D are partial cross-sectional views illustrating a connection structure between a first housing body element and a second body element according to another embodiment of the disclosure.
Figure 6B:
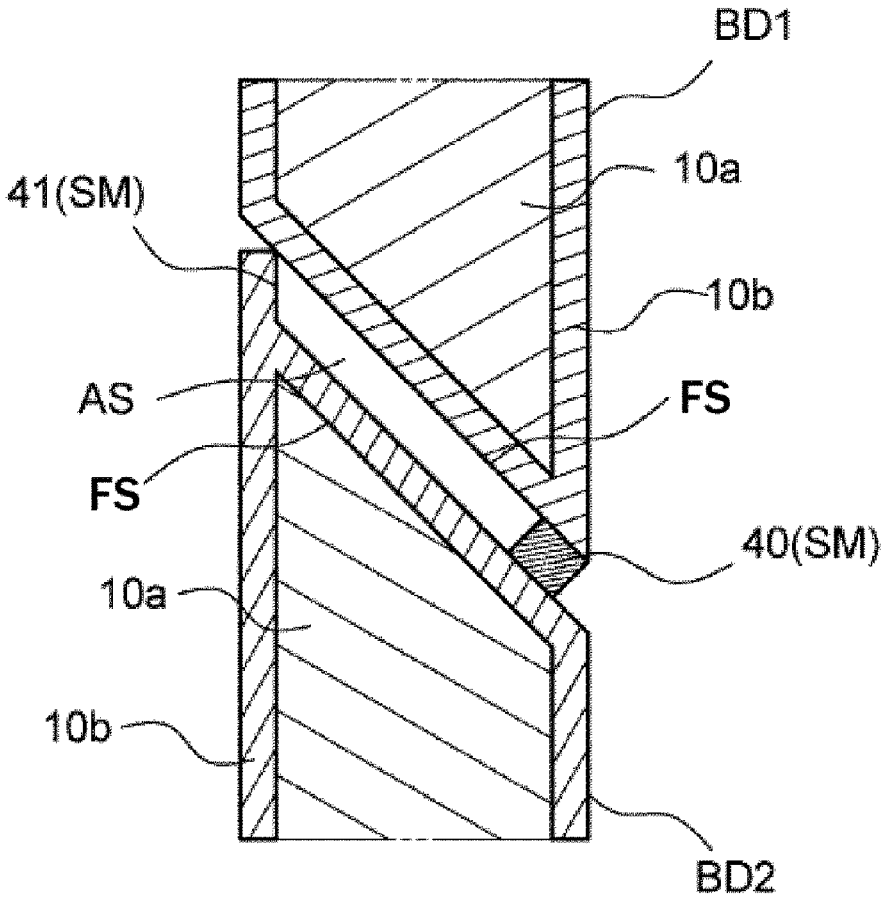

As for the sealing mechanism SM of FIG. 6A, the partition member 41 may be in the form of rib in which the exterior material 10*b* forming the end surface (facing surface: FS) protrudes toward the other end surface (facing surface: FS), as illustrated in FIG. 6B.

Figure 6C:
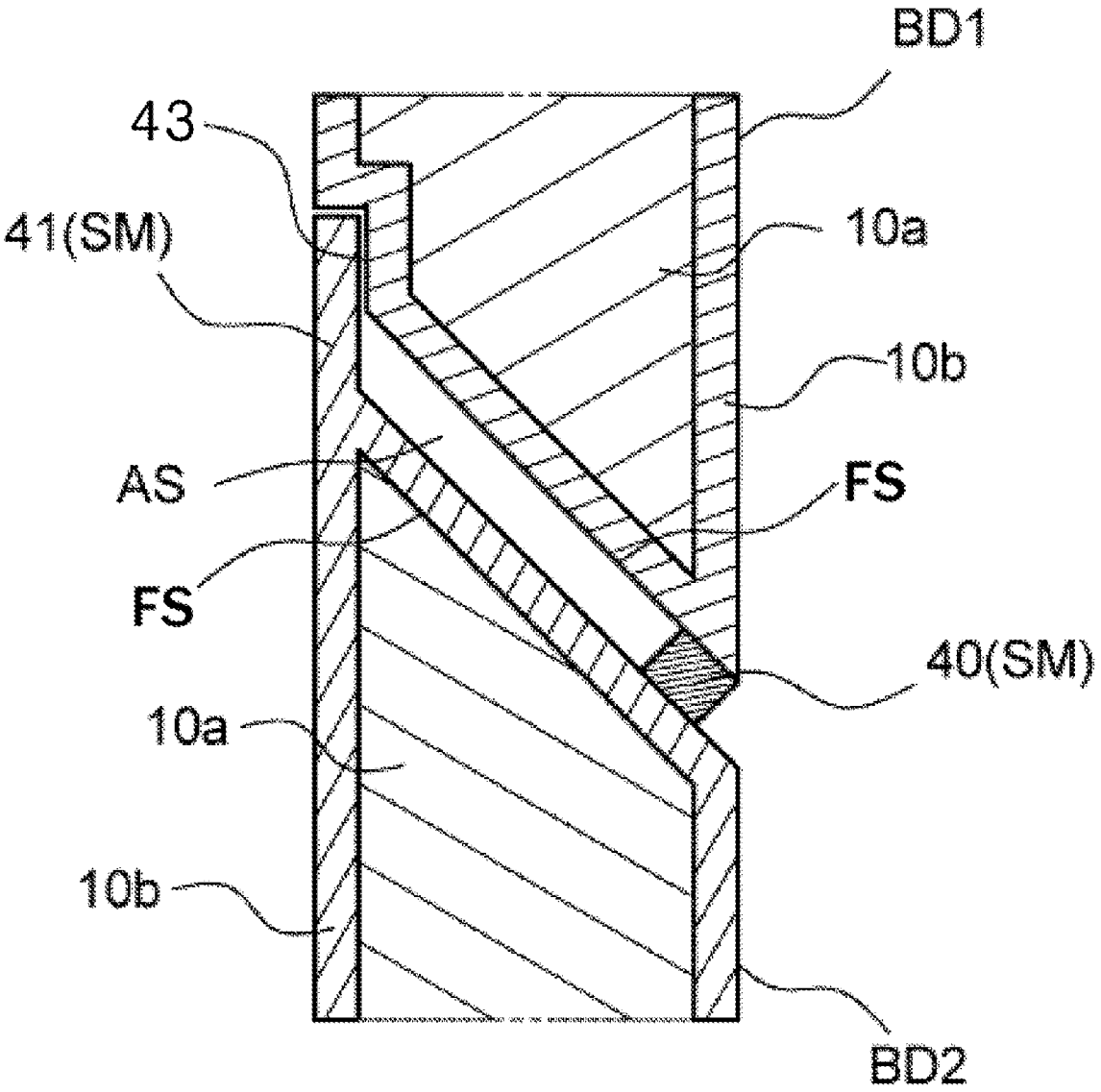

Alternatively, as illustrated in FIG. 6C, an inserted coupling groove 43 may be formed on the other end surface (facing surface: FS) and an end portion of the partition member 41 having the rib shape may be inserted-coupled to the inserted coupling groove 43. Therefore, the air-tightness of the air surface AS may be improved.

Figure 6D:
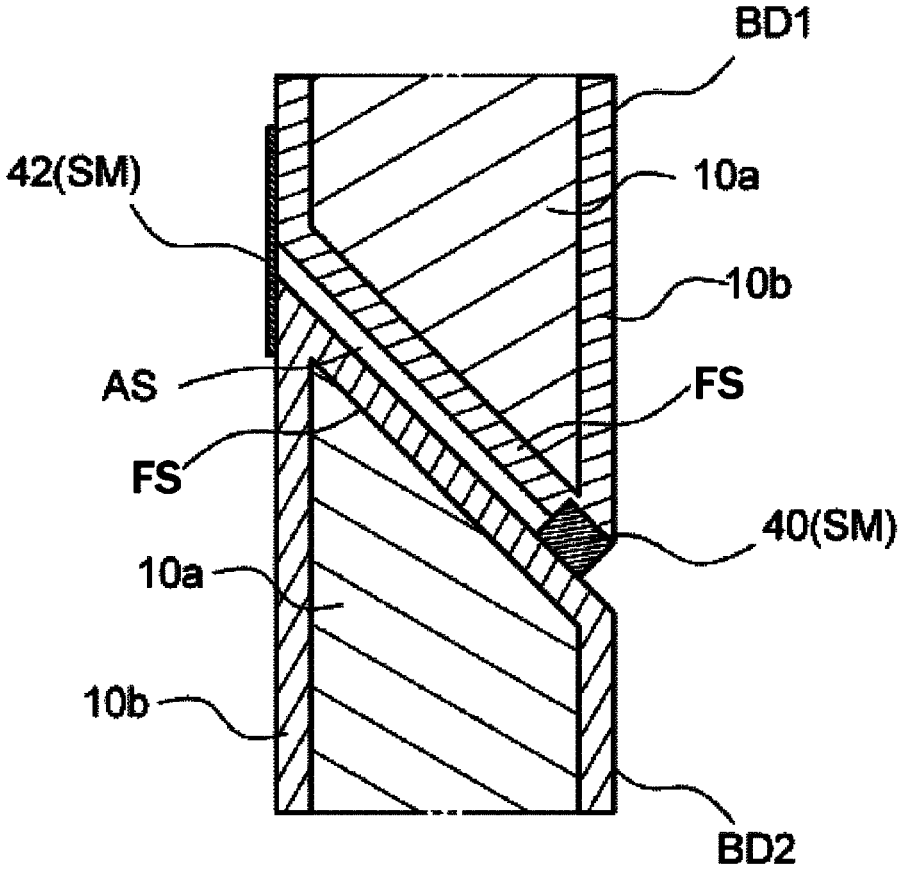

Alternatively, a sealing mechanism SM illustrated in FIG. 6D is a modification of the sealing mechanism SM according to an embodiment. Particularly, the sealing mechanism SM illustrated in FIG. 6D may include a sealing member 40 formed along the circumferential direction along the opposite end surfaces (facing surface: FS) and a blocking member 42 configured to block a gap between the opposite end surfaces (facing surface: FS) about an outer surface of the both housing body elements BD1 and BD2 toward the outside of the refrigerator. Accordingly, an air surface AS formed along the circumferential direction of the opposite end surfaces (facing surface: FS) is formed between the sealing member 40 and the blocking member 42.

In addition, as illustrated in FIG. 6D, the blocking member 42 may be formed in the form of tape and configured to cover the outer surface of the both housing body elements BD1 and BD2 toward the outside of the refrigerator. In this case, the tape-shaped blocking member 42 may be attached by an adhesive or an adhesive agent or may be mechanically fixed by an installation tool formed of resin or metal.

Figure 7A:
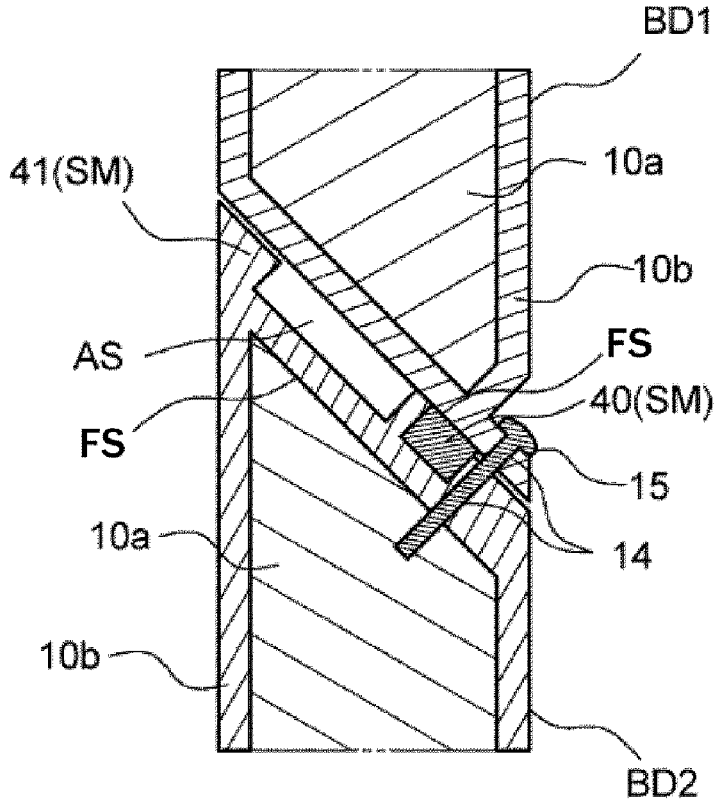
FIGS. 7A and 7B are partial cross-sectional views illustrating a connection structure between a first housing body element and a second body element according to another embodiment of the disclosure.
Figure 7B:
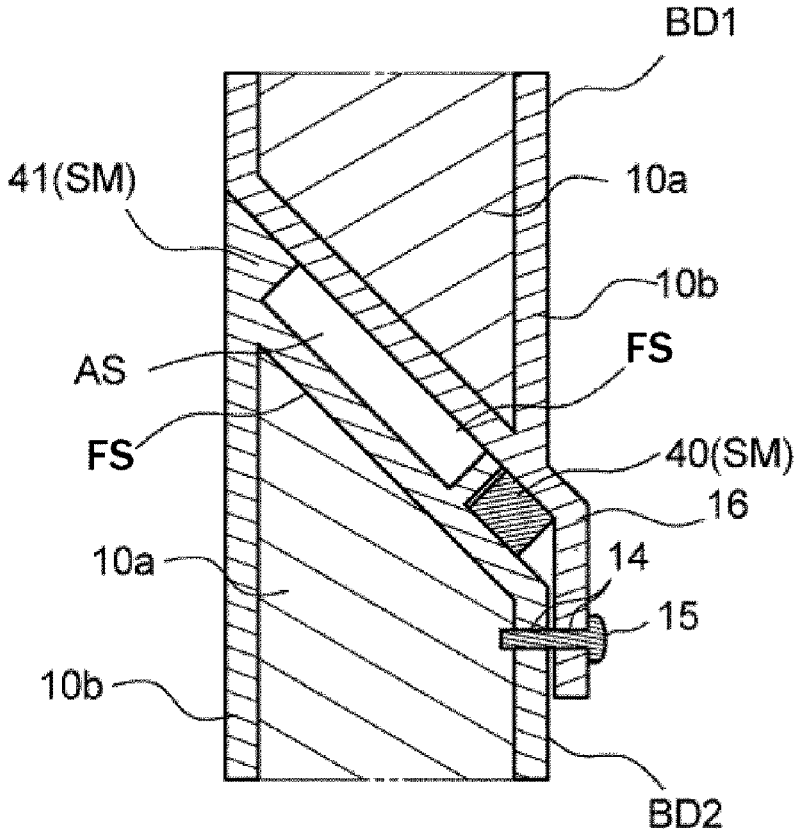

According to another embodiments, opposite end surfaces (facing surface: FS) may be fastened by a fastening mechanism, as illustrated in FIG. 7. Further, a screw hole 14 may be formed to pass through the exterior material 10*b* forming the opposite end surfaces (facing surface: FS) and a screw 15 may be inserted into the screw hole 14, as illustrated in FIG. 7A. Alternatively, as illustrated in FIG. 7B, an extension 16 extending from an exterior material 10*b* of one side housing body element BD1 to follow the exterior material 10*b* of the other side housing body element BD2 may be installed, a screw hole 14 may be formed to pass through the extension 16 and the exterior material 10*b* of the other side housing body element BD2, and the screw 15 may be inserted into the screw hole 14.

In addition, as illustrated in FIG. 8, a heat transfer member 50 configured to induce heat toward the outside of the refrigerator in the one pair end surface (facing surface: FS) may be installed on at least one side of the first housing body element BD1 and the second housing body element BD2.

As illustrated in FIG. 8, on the outer wall 10*x* of the rear plate 11*d* forming the housing body BD, a temperature thereof is reduced as being closer to a refrigerator outer edge portion A (hereinafter referred to as an outer edge portion) of the end surface (facing surface: FS) and a temperature thereof is increased as being further from the outer edge portion A of the end surface (facing surface: FS) that is a temperature thereof is increased as being further from the outer edge portion A in a height direction of the housing body BD. In other words, the outer edge portion A of the end surface (facing surface: FS) corresponds to a portion vulnerable to condensation in the outer wall 10*x*.

Therefore, on at least one outer wall 10*x* of the first housing body element BD1 and the second housing body element BD2, the heat transfer member 50 may be installed along a direction separated from the outer edge portion A of an opposing surface X1, and thus heat on the high temperature side in the outer wall 10*x* may be transferred to the outer edge portion A of the end face (facing surface: FS).

More particularly, as illustrated in FIG. 8, the heat transfer member 50 may be installed along the height direction of the housing body BD on the outer wall 10*x* of the rear plate 11*d* of the housing body BD. Alternatively, the heat transfer member 50 may be installed on a whole width direction of the second housing body element BD2 along a width direction of the second housing body element BD2 (a direction to which the side plate 11*a* of the housing body BD faces).

The heat transfer member 50 may include a first element 51 installed between the outer wall 10*x* and the inner wall 10*y* of the first housing body element B1 that is the inside of the first housing body element BD1, and installed along an inner surface X2 of the outer wall 10*x*, and a second element 52 installed along a rear surface X3 of the end surface (facing surface: FS). That is, the heat transfer member may be bent from the inner surface X2 of the outer wall 10*x* to the rear surface X3 of the end surface (facing surface: FS). Because the second element 52 servers as a reinforcement member due to the above mentioned configuration, the heat transfer member 50 according to the embodiment may also serve as a reinforcement member.

The first element 51 is installed on the inner surface of the outer wall 10*x* and extends in a predetermined direction. In consideration of transferring the heat on the high temperature side on the outer wall 10*x* to the outer edge portion A of the end surface (facing surface: FS), a length L1 of the extension direction (according to the embodiment, it corresponds to a height direction of the housing body BD) may be large, but this may lead to an increase in manufacturing cost.

Therefore, according to the embodiment, in order to achieve the heat transfer characteristics by the heat transfer member 50 while suppressing the increase in the manufacturing cost, the length L1 of the first element 51 may be 1 mm or more and 200 mm or less along the height direction of the housing body BD.

In consideration of functions as the reinforcing member, a length L2 of the second element 52 may be large. However, when the second element 52 has a long length L2, there is a risk that the cool air inside the refrigerator may cool the outer edge portion A of the end surface (facing surface: FS) through the second element 52.

Therefore, according to the embodiment, in order to exhibit the function as a reinforcing member, without cooling the outer edge portion A of the end surface (facing surface: FS), the length L2 of the second element 52 is set to be equal to or less than half of a length from the outer wall 10*x* to the inner wall 10*y* in the rear surface X3 of the end surface (facing surface: FS).

In addition, according to the embodiment, the heat transfer member 50 may be 10 μm or more and 3 mm or less in thickness, in order to suppress the increase in manufacturing cost, while achieving the heat transfer characteristics.

It is appropriate that the thermal conductivity of the heat transfer member 50 is equal to or higher than the thermal conductivity of iron or stainless steel (for example, acrylonitrile butadiene stainless steel: ABS) forming the housing body BD or the cooling cycle mechanism CM, and it is appropriate that the thermal conductivity of heat transfer member 50 is 100 times or more of the thermal conductivity of the insulating material 10*a*, which is enclosed inside the housing body BD, such as polyurethane.

The heat transfer member 50 may be formed of a thermal conductor such as a metal foil tape, a metal piece, or a carbon graphite sheet, but in this embodiment, sheet member such as iron and aluminum is used as the heat transfer member 50

Because the refrigerator 100 configured as described above accommodates the cooling cycle mechanism CM in the second housing body element BD2, the large capacity refrigerator 100 may be cooled by a small amount of refrigerant and thus it is possible to improve the maintenance of the refrigerant circuit.

In addition, because the heat transfer member 50 for inducing heat of the outer edge portion A of the end surface (facing surface: FS) is provided on the outer wall 10*x* of the first housing body element BD1, it is possible to prevent the occurrence of condensation on the outer wall 10*x* of the housing body BD.

Figure 9:
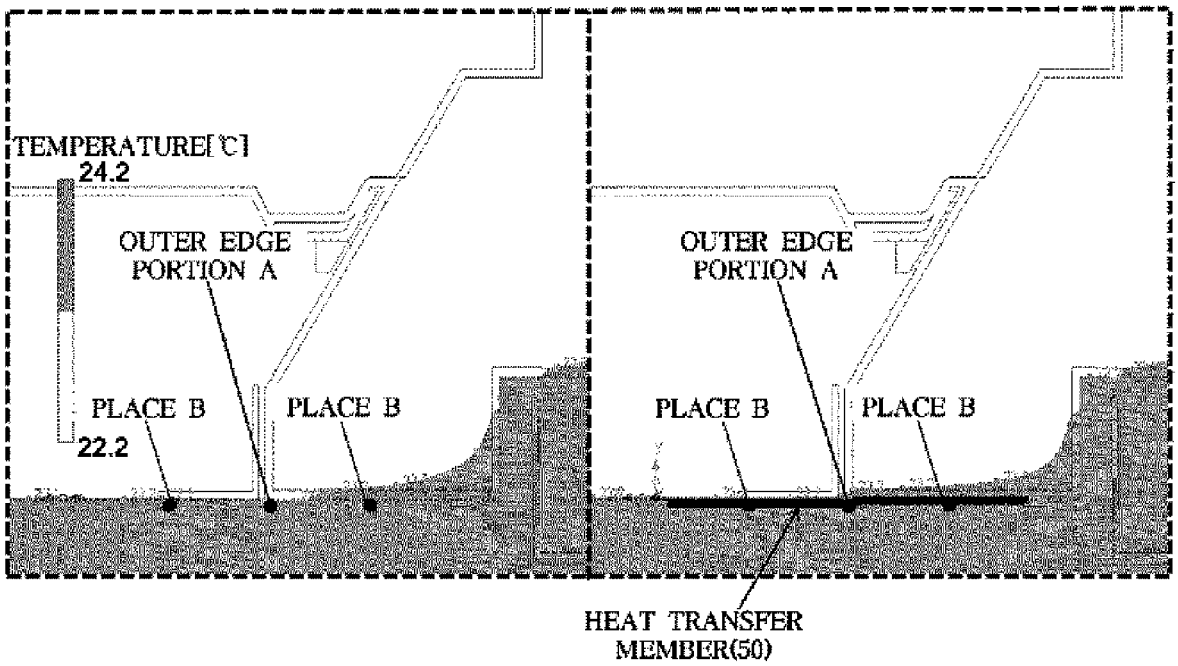
FIG. 9 is a view illustrating a test result of comparing the disclosure with the conventional configuration.

This is illustrated in a test result as shown in FIG. 9. This is test measures the temperature of the outer edge portion A of the end surface (facing surface: FS) while measuring a temperature difference with surrounding portions B (particularly two places), and compares the measured temperature with the conventional structure. Further, as the heat transfer member 50, an aluminum tape having a thickness of 50 μm is used. In addition, dew point temperature in this test condition is 23.2° C., and when the temperature becomes below the dew point temperature, the condensation will occur.

From this test result, it can be seen that in the conventional structure, the temperature of the outer edge part A of the end surface (facing surface: FS) is 22.3° C., and the difference with the surrounding portion B (23.9) is not greater than 1.6 degrees. However, it can be seen that in the structure of this embodiment, the temperature of the outer edge portion A of the end face (facing surface: FS) is 23.4° C., and the difference with the surrounding portion B 24 is not greater than 0.6 degrees.

Accordingly, by using the structure of this embodiment, it is possible to reduce the temperature difference with the surrounding portion B, and it is possible to increase the temperature of the outer edge part A of the end surface (facing surface: FS) and thus it is possible to prevent the occurrence of condensation.

In addition, because the heat transfer member 50 is arranged inside the first housing body element BD1, it does not damage the appearance.

Further, because the heat transfer member 50 is installed not only on the inner surface X2 of the outer wall 10*x* of the first housing body element BD1 but also on the rear surface X3 of the end surface (facing surface: FS), the heat transfer member 50 may server as a reinforcing member.

Further, because the heat transfer member 50 is provided along the width direction of the second housing body element BD2, it is possible to prevent the occurrence of condensation over the wide range of this width direction.

In addition, this disclosure is not limited to the above mentioned embodiment.

Figure 10A:
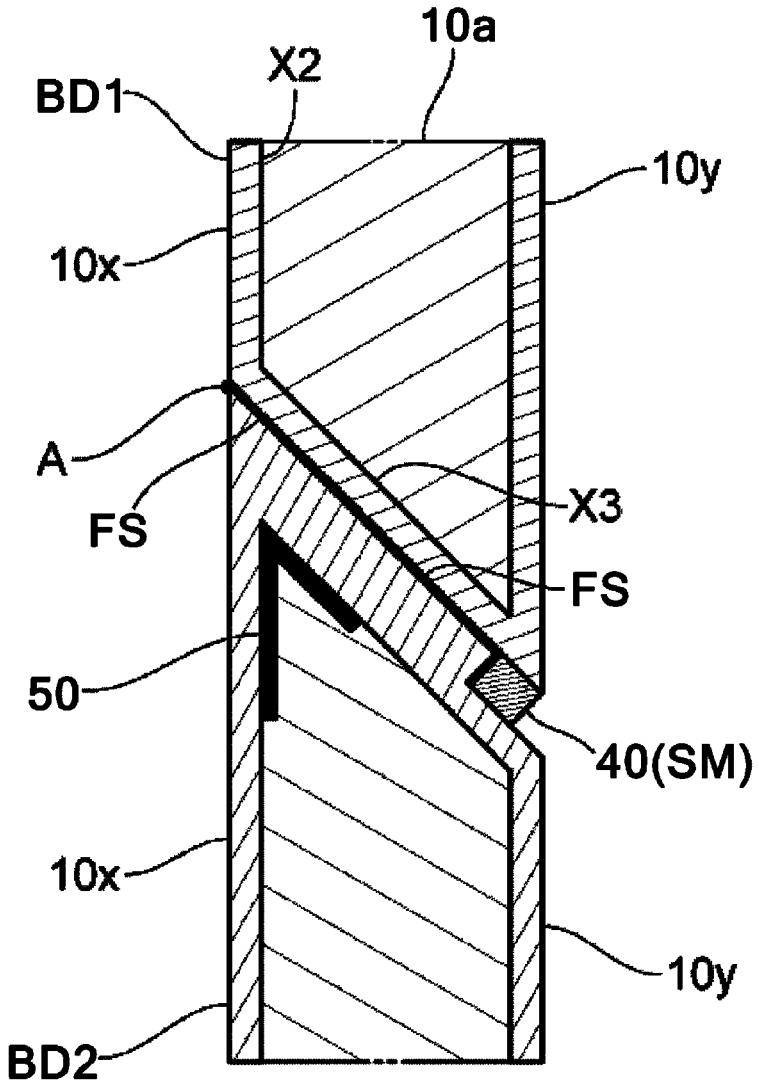
FIGS. 10A and 10B are schematic diagrams illustrating a heat transfer member according to another embodiment of the disclosure.
Figure 10B:
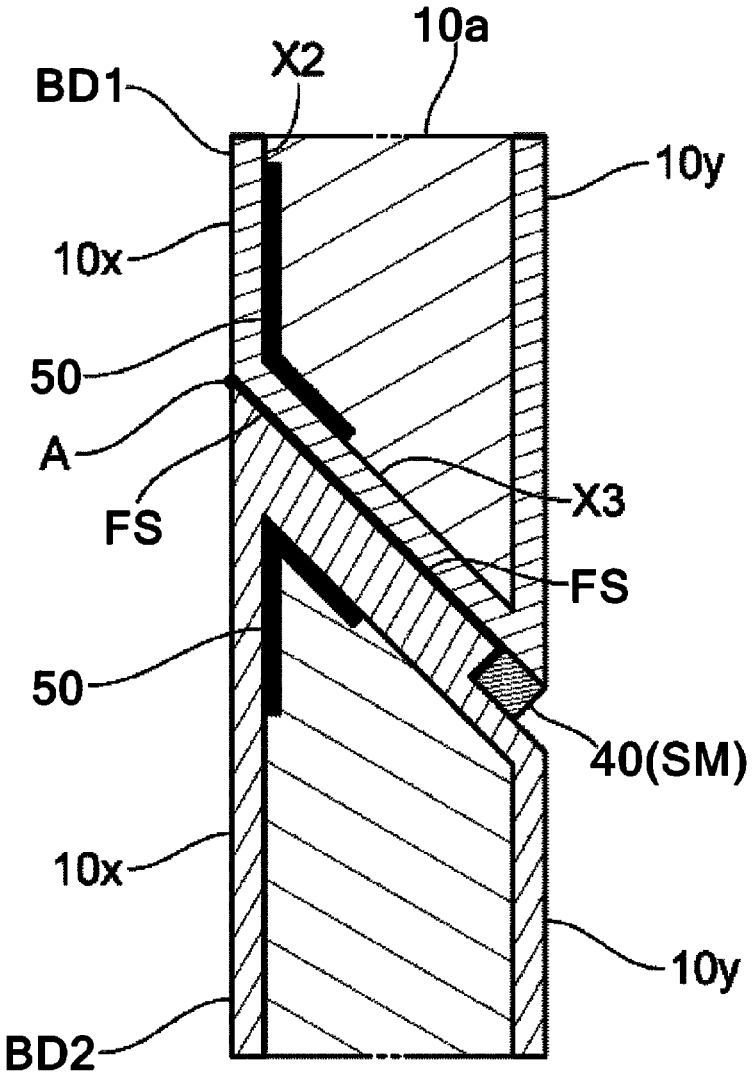

For example, according to the above mentioned embodiment, the heat transfer member 50 is installed in the first housing body element BD1, but alternatively, the heat transfer member 50 may be installed in the second housing body element BD2, as illustrated in FIG. 10A. Alternatively, the heat transfer member 50 may be installed in both of the first housing body element BD1 and the second housing body element BD2, as illustrated in FIG. 10B. Further, although not shown, the heat transfer member 50 may be installed in the outer surface of the outer wall 10*x*.

Figure 11:
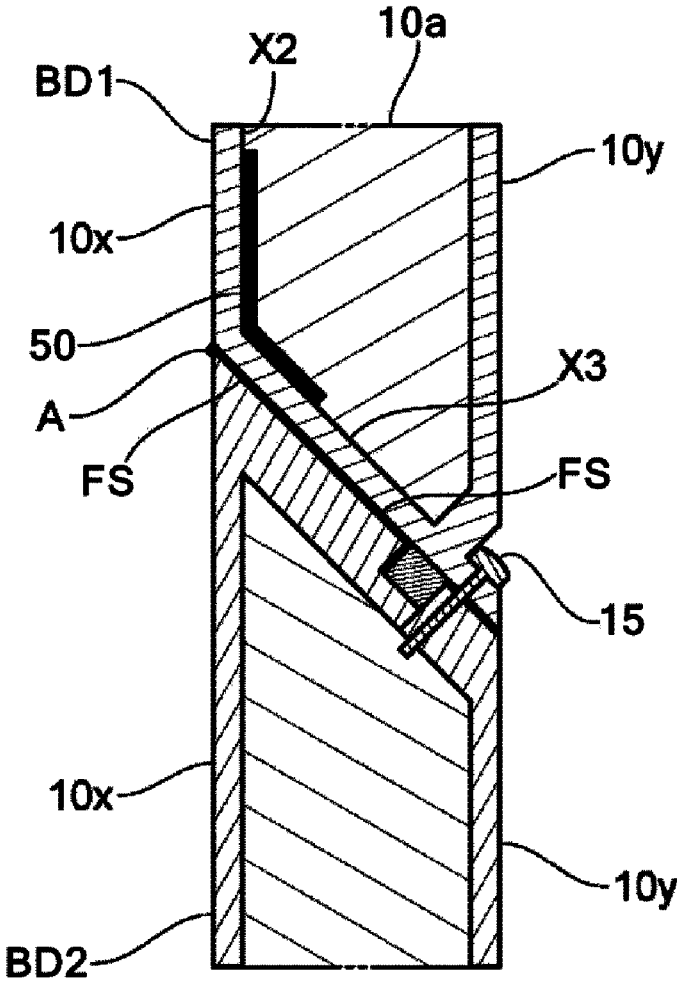
FIG. 11 is a schematic diagram illustrating a fastening member according to still another embodiment of the disclosure.

As a method in which the second housing body element BD2 is coupled to the first housing body element BD1, a method of using a fastening member 15 such as a screw may be employed, as illustrated in FIG. 11.

More particularly, the fastening member 15 is provided in the inside of the refrigerator on the end surface (facing surface: FS), and penetrates the pair of the end surfaces (facing surface: FS).

With such a configuration, the fastening member 15 is not visible from the outside and does not damage the aesthetic appearance, and at the same time, it is possible to prevent the occurrence of condensation in the fastening member 15.

Figure 12:
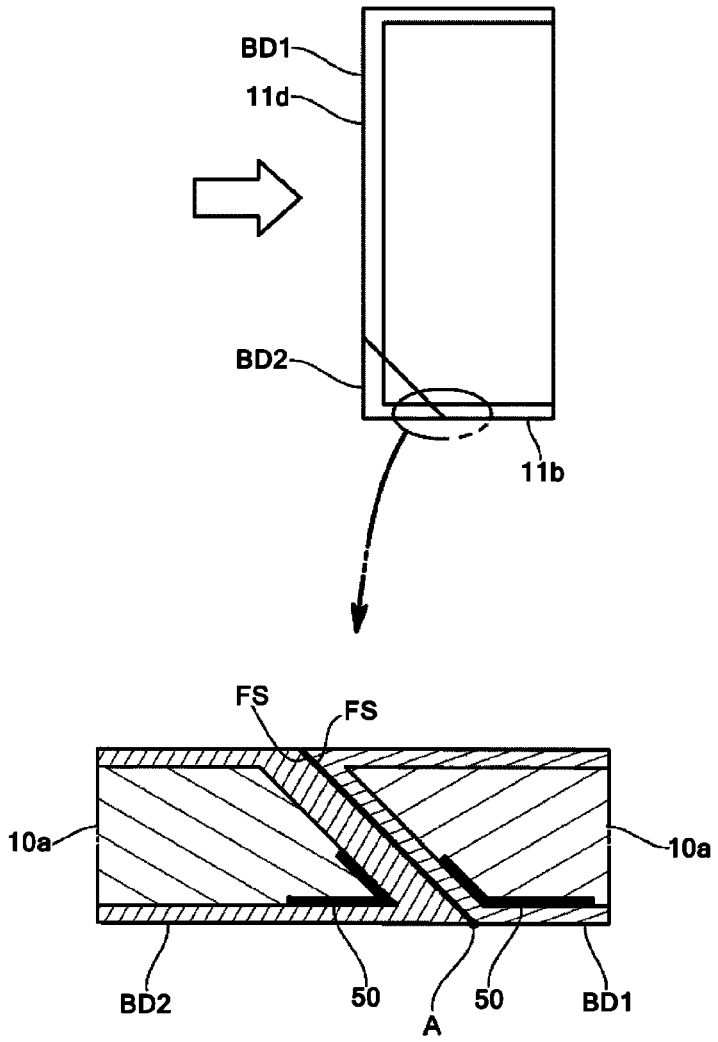
FIG. 12 is a schematic diagram illustrating a fastening member according to still another embodiment of the disclosure.

Further, as illustrated in FIG. 12, on the outer wall 10*x* of the bottom plate 11*b* forming the housing body BD, a temperature thereof is reduced as being closer to an outer edge portion A of the end surface (facing surface: FS) and a temperature thereof is increased as being further from the outer edge portion A of the end surface (facing surface: FS) that is a temperature thereof is increased as being further from the outer edge portion A in a height direction of the housing body BD.

Therefore, as illustrated in FIG. 12, in the same manner as the rear plate 11*d*, on the bottom plate 11*b*, the heat transfer member 50 may be installed along at least the depth direction of the housing body BD on one side or both side of the first housing body element BD1 and the second housing body element BD2.

According to the above mentioned embodiment, the second housing body element BD2 is formed by obliquely cutting off the lower portion of the rear surface side of the housing body BD, but is not limited thereto. Therefore, the second housing body element BD2 may be formed by cutting the lower portion of the rear surface side of the housing body BD into a stepped shape or a curved shape. That is, the end surface (facing surface: FS) formed on the first housing body element BD1 and the second housing body element BD2, is not limited to an inclined surface inclined downward toward the front, and thus the end surface (facing surface: FS) may have a step surface or a curved surface.

In addition, the cutting position of the second housing body element BD2 may be variable such as the upper portion of the rear surface side or the lower portion of the side surface side of the housing body BD.

As is apparent from the above description, it is possible to easy access to an evaporator forming a cooling cycle mechanism, and to prevent the occurrence of condensation in a divided portion of a housing body.

Although a few embodiments of the disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a housing body comprising an inner space of the refrigerator and a plurality of housing body elements separated along a predetermined separate surface; and a cooling cycle system configured to cool the inner space of the refrigerator;

wherein:

the plurality of housing body elements comprises a first housing body element and a second housing body element removably coupled to each other to allow an end surface of the first housing bod element to face an end surface of the second housing body element;

a sealing system configured to form an air surface between opposite end surfaces of the first housing body element and the second housing body element is provided to prevent air from flowing into or from the inner space between the opposite end surfaces;

the first housing body element comprises a partition configured to divide the inner space of the refrigerator, and the first housing body element is configured to form a storage room of the inner space of the refrigerator on one side of the partition;

the second housing body element is configured to form a re-cooling room of the inner space of the refrigerator on another side of the partition, and the second housing body element is further configured to form a machine room in an outside of the inner space of the refrigerator; and the end surface of the second housing body element is coupled to the end surface of the first housing body element to form the re-cooling room together with the first housing body element and the partition.

2. The refrigerator of claim 1, further comprising an evaporator configured to:

introduce gas for cooling the inner space from an entrance surface;

re-cool the gas; and output the re-cooled gas to an exit surface, wherein the sealing system is configured to form the air surface between the opposite end surfaces around the exit surface.

3. The refrigerator of claim 1, wherein the sealing system further comprises a blocking member installed on an outer surface of the plurality of housing body elements to block a gap between the opposite end surfaces.

4. The refrigerator of claim 1, wherein the cooling cycle system comprises:

an evaporator arranged at a side of the inner space of the refrigerator in the second housing body element;

a compressor arranged in the machine room; and a condenser arranged in the machine room.

5. The refrigerator of claim 1, wherein:

each of the plurality of housing body elements comprises an insulating material and an exterior material covering the insulating material; and the exterior material includes a thermal conductivity higher than a thermal conductivity of the insulating material.

6. The refrigerator of claim 1, wherein the opposite end surfaces are formed to be inclined from a rear surface of the housing body toward a bottom surface of the housing body.

7. The refrigerator of claim 1, wherein a heat transfer member configured to induce heat toward an outside of the refrigerator in an end surface is installed on one of the plurality of housing body elements.

8. The refrigerator of claim 1, wherein the sealing system comprises a sealing member inserted between the opposite end surfaces to form a gap between the opposite end surfaces.

9. The refrigerator of claim 8, wherein the sealing system further comprises a partition member configured to partition the gap formed between the opposite end surfaces to form the air surface with the sealing member.

10. The refrigerator of claim 9, wherein the partition member forms the air surface by partitioning the gap, that is formed between the opposite end surfaces, into the form of a frame.

11. The refrigerator of claim 9, wherein the partition member is formed in a manner that an exterior material forming one of the opposite end surfaces protrudes toward the end surface of the other housing body element among the opposite end surfaces.

* * * * *